US005753392A

United States Patent [19]

Ray et al.

[11] Patent Number: 5,753,392

[45] Date of Patent: May 19, 1998

[54] METHOD OF ELECTROSTATICALLY PRINTING IMAGE-ENHANCING PARTICLES AND SAID PARTICLES

[75] Inventors: Bradley R. Ray, Woodbury; William D. Sell, St. Paul, both of Minn.

[73] Assignee: Minnesota Mining and Manufacturing Company, St. Paul, Minn.

[21] Appl. No.: 518,822

[22] Filed: Aug. 24, 1995

[51] Int. Cl.[6] ..... G03G 9/09

[52] U.S. Cl. ..... 430/45; 430/47

[58] Field of Search ..... 430/45, 49, 47

[56] References Cited

U.S. PATENT DOCUMENTS

| | | | |
|---|---|---|---|
| 2,963,378 | 12/1960 | Palmquist et al. | 106/193 |
| 3,700,305 | 10/1972 | Bingham | 350/105 |
| 4,731,239 | 3/1988 | Gordon | 424/9 |
| 5,147,745 | 9/1992 | Russel | 430/49 |
| 5,177,877 | 1/1993 | Duchesne et al. | 355/291 |

FOREIGN PATENT DOCUMENTS

| | | | |
|---|---|---|---|
| 0 423 756 A1 | 4/1991 | European Pat. Off. | C07C 179/18 |
| 0 467 439 A1 | 1/1992 | European Pat. Off. | G03G 9/097 |
| 0 488 742 A1 | 6/1992 | European Pat. Off. | G03G 9/097 |
| 0 640 883 A1 | 3/1995 | European Pat. Off. | G03G 9/097 |
| 62-100771 | 5/1987 | Japan . | |
| 1-112254 | 4/1989 | Japan . | |

*Primary Examiner*—John Goodrow

*Attorney, Agent, or Firm*—Janice L. Dowdall

[57] ABSTRACT

The present invention relates to a novel method of producing graphics employing image-enhancing particles electrostatically. The invention also relates to novel electrostatically printable image-enhancing particles.

26 Claims, No Drawings

METHOD OF ELECTROSTATICALLY PRINTING IMAGE-ENHANCING PARTICLES AND SAID PARTICLES

FIELD OF THE INVENTION

The present invention relates to a novel method of producing graphics employing image-enhancing particles electrostatically. The invention also relates to novel electrostatically printable image-enhancing particles.

BACKGROUND OF THE INVENTION

Decorative graphics for automotive trim and ornamentation have been conventionally produced by screen printing an ink onto an adhesive coated film. Image-enhancing particles are often incorporated into these printing inks to provide an interesting visual appearance such as sparkle, color flop, iridescence or luster. Representative examples of image-enhancing particles include metallic flake and spherical particles, such as aluminum flake or aluminum spheres, pearlescent flake pigments such as metallic oxide coated mica, metallic oxide coated glass flake, and metallic oxide coated polyester flake. These image-enhancing particles are usually in the 1–200 microns diameter size range. Particles in the range of about 1–20 microns generally exhibit more of a lustrous appearance, while particles larger than 20 microns generally have an increasing amount of a sparkle appearance, that increases as the particle size increases. Some image-enhancing particles are more functional in nature. For example, phosphors can be used to make an electroluminescent lamp or metallic coated glass beads can be used to provide retroreflection.

However, it would be desirable to replace analog printing methods such as screen printing with a digital printing method in order to reduce cycle times and produce short runs economically. In addition, most digital printing processes eliminate the need for printing plates and significantly reduce job set-up and changeover times.

While digital color printing is well known in the graphics industry, digitally printing the breadth of image-enhancing particles used in the screen printing industry has largely been ignored. This may be due to the particle size and/or the conductivity of many image-enhancing particles such as, for example, aluminum flake. The use of a particular type of image-enhancing particle, titanium oxide coated flake-form inorganic crystal, in colored toner formulations is taught in Japanese Patent Kokai No. Sho 62[1987]-100771. Kokai No. Hei 1[1989]-112254 further teaches use of the above mentioned flake-form particles first coated with a black titanium oxide layer in toner formulations that are preferably colored. However, a wider range of decorative or functional effects are desired requiring a much wider range of image-enhancing particles.

Known methods of utilizing image-enhancing particles in solid toners involve compounding a separate batch of toner containing image-enhancing particles for each color in which an image-enhancing effect is desired. For example, green toner may be compounded with metallic flake to produce a metallic green color. Likewise, if a metallic red was desired, metallic flakes would be compounded with red toner, etc. Thus, for every different color and concentration of image-enhancing particles, a separate batch of toner compounded with image-enhancing particle was required. Making small batches of toner and image-enhancing particles is a costly process with no economies of scale. Therefore, it would be further desirable to achieve multiple color image-enhancing effects without having to produce multiple batches of color toner containing image-enhancing particles.

Because print resolution is largely determined by the particle size of toner and many desirable image-enhancing effects require particle sizes in excess of conventional higher resolution toner particles sizes, it would be still further desirable to print digitally larger image-enhancing particles without sacrificing overall image resolution.

SUMMARY OF THE INVENTION

The present invention, which overcomes the difficulties of known printing methods, employs an image-enhancing particle at least partially coated with an electrostatically chargeable material free of dyes and pigments according to the restrictions set forth herein. This electrostatically chargeable material may be, for example, a toner material which is free of dyes and pigments. These modified image-enhancing particles of the invention are referred to herein also as "electrostatically printable image-enhancing particles."

The electrostatically printable image-enhancing particles of the invention can be used in a number of methods. In one such method, electrophotography, the electrostatically printable image-enhancing particles can be added to any colored toner (preferably transparent or translucent colored toner so as not to hide the image-enhancing effect) and printed as a dual component mixture or can be applied by itself in a first stage, for example, in a multi-station printer and subsequent colors (in the form of colored toner, for example) applied in registration over the image-enhancing particles in the later print stations.

In addition to electrophotographic printing methods, these image-enhancing particles may also be used in other printing methods employing solid toners such as so-called direct printing. An example of a direct toner printer is the Toner-Jet® made by Array Printers in Sweden. In direct printing, the substrate passed through an electrostatic field which attracts toner to the substrate surface. But the toner must first pass through an array of microscopically fine apertures, each surrounded by a ring electrode. Dots are formed directly on the substrate by charging the ring electrodes to add to the attraction of the substrate and thereby release "jets" of toner towards the substrate. Once in place, these dots of toner are fused in place and the apertures are cleaned in preparation for printing the next line.

For multi-station printers, a preferred method of creating an enhanced appearance is to apply the amount of image-enhancing particles that are desired at the first printing station and to print the desired color in subsequent stations. A common method of creating many colors from only a few primaries is to use cyan, magenta, yellow, and black primaries in what is called a 4-color process. This technique is particularly useful with the current invention and enables one to print many different colored image-enhancing graphics, without the expense of many different developer units or of cleaning the developer units many times.

We have thus discovered a novel method of printing image-enhancing particles. The method of the invention has a number of distinct advantages, including but not limited to those discussed above, when compared to known methods. Our novel method of electrostatically printing image-enhancing particles comprises the steps of:

(a) providing a first image on a substrate via an electrostatic printing means wherein the first image is formed from a first composition comprising:

(I) optionally, electrostatically printable image-enhancing particles, each electrostatically printable image-enhancing particle comprising:

(A) an image-enhancing particle; and (B) an electrostatically chargeable material attached to at least a portion of an exterior surface(s) of the image-enhancing particle, wherein the electrostatically chargeable material is free of dyes and pigments and wherein the electrostatically chargeable material is selected from the group consisting of transparent materials, translucent materials, opaque materials, and combinations thereof, wherein the electrostatically chargeable material comprises: (i) an electrostatically chargeable polymeric material, and (ii) optionally a charge controlling compound; wherein no more than 80% of the exterior surface of each image-enhancing particle may have an opaque electrostatically chargeable material attached thereto;

(II) optionally toner particles containing a component selected from the group consisting of dyes, pigments, and combinations thereof, wherein at least one of (a)(I) and (a)(II) is present;

(b) optionally providing one or more subsequent image(s) in registration with said first image wherein said subsequent image(s) are independently formed from a subsequent composition, each subsequent composition independently comprising:

(I) optionally, electrostatically printable image-enhancing particles, each electrostatically printable image-enhancing particle comprising:

(A) an image-enhancing particle; and (B) an electrostatically chargeable material attached to at least a portion of an exterior surface(s) of the image-enhancing particle, wherein the electrostatically chargeable material is free of dyes and pigments and wherein the electrostatically chargeable material is selected from the group consisting of transparent materials, translucent materials, opaque materials, and combinations thereof, wherein the electrostatically chargeable material comprises: (i) an electrostatically chargeable polymeric material, and (ii) optionally, a charge controlling compound; wherein no more than 80% of the exterior surface of each image-enhancing particle may have an opaque electrostatically chargeable material attached thereto;

(II) optionally, toner particles containing a component selected from the group consisting of dyes, pigments, and combinations thereof;

wherein at least one of (b)(I) and (b)(II) is present in each subsequent composition, wherein at least one of said first image and/or said subsequent image(s), if present, are formed from a composition comprising electrostatically printable image-enhancing particles; and (c) fusing the deposited image(s) wherein the deposited image(s) are fused at least after the last deposited image is formed, and optionally, in addition, after any previous deposited image(s) are formed.

The present invention also provides the printed substrates prepared according to the method of the invention.

The present invention also provides the above discussed novel electrostatically printable particles, each particle comprising:

(a) an image-enhancing particle excluding mica particles coated with a layer of black titanium oxide;

(b) an electrostatically chargeable material attached to at least a portion of an exterior surface(s) of the image-enhancing particle, wherein the electrostatically chargeable material is free of dyes and pigments and wherein the electrostatically chargeable material is selected from the group consisting of transparent materials, translucent materials, opaque materials, and combinations thereof, wherein the electrostatically chargeable material comprises: (i) an electrostatically chargeable polymeric material, and (ii) optionally, a charge controlling compound; wherein no more than 80% of the exterior surface of each image-enhancing particle may have an opaque electrostatically chargeable material attached thereto.

One particular printing method useful in the method of the present invention is electrophotography. In electrophotography, a latent image is formed on a charged photoconductor by image-wise exposure to a light source such as a laser or a light emitting diode. The latent image on the photoconductor is then developed with either a single-component or a two-component developer. In either case, the developer is generally metered out onto a rotating sleeve with a permanently aligned magnetic core.

In the case of a single-component developer, the developing composition consists of only a magnetic toner. Because magnetic materials are generally dark in color, single-component developers are mainly used for black and white printing. In order to achieve suitable colors in color printing, two-component developers are used which consist of non-magnetic toner(which can therefore be brightly colored) and magnetic carrier particles. Typically, tribocharging is used to create opposite electrostatic charges on the toner and magnetic carrier particles which cause the toner to stick to the magnetic carrier. Tribocharging results from the toner and magnetic carrier particles rubbing together in the developer unit. The size of the magnetic carrier particles relative to the toner particles is generally at least 3:1.

In either case, single-component or two-component developing, the polarity of the toner particles is opposite to that of the latent image areas on the photoconductor. In addition, the magnitude of electrostatic charge holding toner on magnetic carrier particles or the magnetic forces holding a single-component toner on the developer sleeve should not be greater than the electrostatic attractive forces of the latent image areas on the photoconductor. The developer unit is often biased so as to influence the relative polarity and/or magnitude of the latent image areas on the photoconductor.

Once the latent image is developed on the photoconductor, it may be transferred electrostatically to the final substrate, generally by using a corona charging device behind the substrate to attract the toner from the photoconductor to the substrate. In the case of multi-color printing, multiple photoconductors can be used, each developing a color and transferring it to the substrate. Optionally, a single photoconductor can be used with multiple developing stations where after each color is developed it is transferred first to an intermediate holding member such as an accumulator belt and then to the final substrate after all images have been accumulated on the intermediate holding member.

After transferring the toner from the photoconductor, residual toner is removed from the photoconductor by means of a brush or flexible scraping blade, residual charge on the photoconductor is erased and the entire process can be repeated. If the photoconductor is a seamless drum or belt, a longer or continuous image can be formed from multiple revolutions of the photoconductor.

Another type of electrophotography utilizes a so-called tri-level developing scheme. In a tri-level electrophotographic printing method, two developing stations of opposite relative polarity are used to develop a single photoconductor which has relatively positive, neutral and negatively charged areas such that two colors can be developed on one photoconductor at the same time. Multiple tri-level devices can also be used as with conventional electrophotography producing, for example, six colors from three tri-level units.

In addition to the aforementioned electrophotographic printing methods, another printing method useful in the method of the present invention are so-called direct printing methods utilizing solid toners. An example of a direct toner printer is the TonerJet® made by Array Printers in Sweden. In direct printing, the substrate passes through an electrostatic field which attracts toner to the substrate surface. But the toner must first pass through an array of microscopically fine apertures, each surrounded by a ring electrode. Dots are formed directly on the substrate by charging the ring electrodes to add to the attraction of the substrate and thereby release "jets" of toner towards the substrate. Once in place, these dots of toner are fused in place and the aperture cleaned in preparation for printing the next line.

Definition of Terms

The following terms are used herein:

The term "electrostatically chargeable" as used herein with respect to a material refers to a material having electrical resistivity greater than or equal to $10^{10}$ ohm-centimeter.

The term "transparent" as used herein refers to a material wherein the ratio of the intensity of undeviated visible light passing through a layer to the incident light is equal to or greater than about 85%.

The term "translucent" as used herein refers to a material wherein the ratio of the intensity of undeviated visible light passing through a layer to the incident light is less than about 85% but greater than about 20%.

The term "opaque" as used herein refers to a material wherein the ratio of the intensity of the undeviated visible light passing through a layer to the incident light is 20% or less.

The term "electrostatic printing means" as used herein refers to printing methods including, but not limited to electrophotography and direct, solid toner printing as described above. However, electrostatic printing means does not refer to electrostatic printing requiring liquid toners used to form images on substrates having conductive and dielectric layers for retaining such toners electrostatically.

The term "colorless" as used herein refers to compositions containing no added dyes or pigments. Such compositions may show slight natural color, such as a clear resin with some yellowness. It also refers to cases where the electrostatically chargeable polymeric material attached to at least a portion of image-enhancing particles has significantly less chroma (not more than 20%, preferably not more than 10%) compared to the chroma of any colored toners used in any compositions.

DETAILED DESCRIPTION OF THE INVENTION

The present invention provides a method of printing image-enhancing particles electrostatically. To print image-enhancing particles electrostatically according to the present invention, an image-enhancing particle which has been modified to behave as a normal toner particle is used. A relatively larger image-enhancing particle (relative to a normal toner particle) which has been modified to behave as a normal toner particle may be used, as one example. In conventional electrophotography, the trend has been toward smaller toner particle size in order to achieve higher print resolutions. For example, as the spatial resolution of electrophotographic print engines has increased from 118 dots per centimeter (dpc) to 236 dpc or higher, the particle size of toner has decreased from perhaps 12 microns to 7 microns or lower. As the size of the toner has changed, so has the size of the magnetic carrier used in two-component developers (from 200 microns for low resolution print engines to 100 microns for high resolution print engines, for example). Conversely, if relatively larger image-enhancing particles are used (to achieve more of a sparkle rather than luster metallic effect, for example) the effective toner particle size may be larger than for conventional high resolution electrophotographic toners and will also require larger size magnetic carrier particles in a two-component developer composition. Therefore, as the size of the image-enhancing particles increases the electrophotographic printable resolution will decrease. The same trend towards the use of smaller toner particles and the resultant effect obtained therefrom is evident in other electrostatic processes.

Another advantage to the printing method of the present invention lies in the capability, in one embodiment, of printing the electrostatically printable image-enhancing particles of the present invention in a first print station of a multi-station printer, followed by subsequent compositions printed in registration in subsequent print stations. If larger size electrostatically printable image-enhancing particles are printed in the first station at lower resolution, followed by subsequent compositions comprising toner which contains dye and/or pigment which are free of image-enhancing particles printed at higher resolution in subsequent print stations, the composite image formed will be of higher resolution because the subsequent compositions which do contain dyes and/or pigments will be of higher image contrast than the image-enhancing particle composition which is free of dyes and/or pigments.

Various embodiments of the present invention are possible. The ones discussed below are several possible embodiments.

One embodiment of the method of the present invention is that wherein the first composition is free of element (a)(II) and wherein subsequent composition(s) are each free of element (b)(I). In such a method the first image is formed from a composition which comprises electrostatically printable image-enhancing particles but which does not comprise a toner containing dyes and/or pigments. In the subsequent step(s) each composition from which an image is formed comprises a toner containing dyes and/or pigments, but does not comprise electrostatically printable image-enhancing particles. Such method may optionally further comprise a step (c) of bonding a clear overlaminate to the fused image (s) after step (b).

Another embodiment of the method of the present invention is that wherein the first composition is free of element (a)(I) and wherein all subsequent composition(s) except for the last subsequent composition are each free of element (b)(I) and wherein the last subsequent composition comprises (b)(1) but is free of (b)(II). In such a method, the first image is formed from a composition which comprises a toner containing dye(s) and/or pigment(s) but which does not comprise electrostatically printable image-enhancing particles. All of the subsequent images, except for the very last formed image, comprises toner containing dye(s) and/or pigment(s) but is free of electrostatically printable image-enhancing particles. The last subsequent image, however, is formed from a composition which does comprise electrostatically image-enhancing particles but does not comprise a toner containing dye(s) and/or pigments(s). Thus according to this method, layer(s) of color can be provided on top of each layer, followed by a colorfree layer which provides, for example, a sparkle effect due to the presence of the electrostatically printable image-enhancing particles. Preferably, according to this method, the substrate is a clear film and the method further comprises a step (c) of bonding the fused image(s) to an element selected from the group consisting of a second substrate and an adhesive layer after step (b).

Another embodiment of the method of the present invention is wherein the electrostatically chargeable image-enhancing particles are in at least one composition(s) free of the toner particles, and wherein the electrostatically chargeable image-enhancing particles in the compositions free of the toner particles are: (1) of a larger dimension than the dimensions of the toner particles which are in any of the compositions which are free of electrostatically chargeable image-enhancing particles; and (2) of a larger dimension than the dimensions of any toner particles which are combined in any of the compositions with electrostatically printable image-enhancing particles; and (3) of a larger dimension than the dimensions of any electrostatically printable image-enhancing particles combined in any of the compositions with the toner particles.

A variety of methods of modifying the image-enhancing particles to behave as normal toner particles may be utilized. Suitable methods include but are not limited to the following: spray-drying the image-enhancing particles with toner resin free of dyes and pigments; extruding the image-enhancing particles with toner resin free of dyes ands pigments; etc. Extruding image-enhancing particles with toner resin free of dyes and pigments and then pulverizing the resulting blend, although useful, can distort and substantially reduce the particle size distribution of some image-enhancing particles. The resultant appearance is thus altered substantially as well.

As mentioned previously the electrostatically chargeable coating must be attached to at least a portion of the image-enhancing particle. Merely dry blending image-enhancing particles with toner powders does not enable the image-enhancing particles to be printed electrostatically without significant background dusting. Many of these image-enhancing particles that are relatively conductive (such as aluminum flake, for example) are unable to hold a charge so they can be manipulated in the electrostatic process.

Each method of modifying the image-enhancing materials to enable them to behave as toner particles has its advantages and disadvantages. For example, the extrusion process is relatively simple although it may crumple some flake-like image-enhancing particles. Aluminum that is usually used for image-enhancing is preferred in a flat, flake form and these flakes are extremely fragile. Mixing flakes with toner resins in high-shear mixers such as Banbury mixers or twin screw extruders can result in crumpling of the flake which decreases the visual effectiveness of the image-enhancing particle.

Image-Enhancing Particles

Useful image-enhancing particles which can be used in making the electrostatically printable image-enhancing particles may have a variety of shapes. The image-enhancing particles may be symmetrical or asymmetrical. Examples of specific image-enhancing particle shapes include but are not limited to those selected from the group consisting of flakes, spheres (hollow or solid), and combinations thereof The image-enhancing particles preferably have diameters of about 1 to 200 microns, more preferably about 1 to about 100 microns, and most preferably about 5 to about 50 microns. Particles having diameters in the range of about 1–20 microns generally exhibit more of a lustrous appearance, while particles having diameters larger than about 20 microns generally have an increasing amount of a sparkle appearance, that increases as the particle size increases.

Image-enhancing particles that are useful according to the method of the present invention include but are not limited to those selected from the group consisting of metallic particles including but not limited to those selected from the group consisting of aluminum, brass, stainless steel, bronze, copper, tin, gold, silver, platinum, rubidium, and mixtures thereof, pearlescent particles including but not limited to those selected from the group consisting of metallic oxide-coated mica, metallic oxide-coated glass, metallic oxide-coated polyester, and mixtures thereof; phosphor particles including but not limited to metallic doped zinc sulfide, for example copper doped zinc sulfide phosphors; glass particles; metallic coated polyester particles and metallic coated glass particles. Examples of metallic coated glass particles include, but are not limited to, the retroreflective glass beads disclosed in U.S. Pat. Nos. 2,963,378 and 3,700,305, both incorporated herein by reference.

Electrostatically Printable Image-Enhancing Particles

An electrostatically chargeable material is attached to at least a portion of an exterior surface(s) of the image-enhancing particle. The chargeable material which should be free of dyes and pigments should be transparent or translucent. The electrostatically chargeable material comprises an electrostastically chargeable polymeric material and optionally a charge controlling compound (preferably about 1 to about 10% by weight of a charge control compound, if included, based on the total weight of the electrostatically chargeable material).

The image-enhancing particle may be partially or completely coated with the chargeable material. Preferably, the image-enhancing particle is completely coated with the electrostatically chargeable material. The coating may be continuous or discontinuous. The image-enhancing particle should have attached thereto a sufficient amount of chargeable material such that the image-enhancing material behaves substantially like a toner particle during the electrostatic printing process (i.e. it should be capable of being moved and positioned via electrostatic printing means). The amount of coating required will vary depending upon the size of the image-enhancing particle and the conductivity of the image-enhancing particles. The lower the resistivity of the electrostatically chargeable material the thicker and/or more complete the coating should be. The more conductive the image-enhancing particle the greater the amount and coverage of the electrostatically chargeable coating required. As one example, an image- enhancing particle of 10 to 50 microns may have a coating of 0.1 to 2 microns. Preferably the weight ratio of the image-enhancing particle to the electrostatically chargeable material attached thereto is about 20:1 to 1:20, more preferably about 5:1 to 1:5, and most preferably about 3:1 to 1:3. One skilled in the art would be able to determine the appropriate amount of electrostatically chargeable material that should be attached to the image-enhancing particle in order for it to behave as a toner particle.

The composition of the electrostatically chargeable image-enhancing particles should be such that upon electrostatically charging, the particle retains its charge for a sufficient length of time to enable the image-enhancing particle to go through the electrostatic printing process until it is transferred to the substrate and/or subsequently fused. This may also include initial attachment to a photoconductor in electrophotography, for example. Typical lengths of time for this process to occur in today's digital color printers can range from less than a second to more than 60 seconds. The exact time period necessary for the image-enhancing particles to retain their charge will depend on the exact method of electrostatic printing employed.

Useful electrostatically chargeable polymeric materials include but are not limited to those selected from the group consisting of acrylic and methacrylic polymers and copolymers such as polymethylmethacrylate and styrene acrylates, polyesters, polyurethanes, polycarbonates, polymers and copolymers of vinyl chloride, copolymers of ethylene with acrylics and methacrylics including ionically crosslinked types, and mixtures thereof. The electrostatically chargeable material should be transparent or translucent and free of pigments and dyes.

Charge controlling compounds are optionally included in the electrostatically chargeable material also. The charge controlling compound should be transparent or translucent and free of pigments and dyes. The charge controlling compounds are preferably colorless or nearly colorless. One example of such a charge controlling compound is a quaternary ammonium functional acrylic polymer. The nature of the charge controlling compound can vary depending upon whether positive or negative charging toner is desired.

Preferably the electrostatically printable image-enhancing particles have average diameters of about 1 to about 200 microns, more preferably about 1 to about 100 microns, and most preferably about 5 to about 50 microns.

Toner

The toner useful in the present invention generally comprises a binder resin, pigment, and a charge controlling compound. These toner ingredients are preferably durable upon outdoor exposure when used to make a decorative automotive graphic, for example. A protective coating or overlaminate (i.e. a film) may also be used to enhance the outdoor durability and/or solvent resistance of the fused toner. Either a protective coating or an overlaminate may also be used to provide the desired gloss. The protective coatings and overlaminates are preferably clear and colorless. The overlaminate, for example, may be bonded to an article comprising a substrate having one or more images fused thereon. The overlaminate may optionally be bonded via an adhesive, for example. The overlaminate would be bonded over the images. Examples of suitable protective coatings and overlaminates include but are not limited to those selected from the group consisting of acrylic and methacrylic polymers and copolymers such as polymethylmethacrylate and styrene acrylates, polyesters, polyurethanes, polycarbonates, polymers and copolymers of vinyl chloride, copolymers of ethylene with acrylics and methacrylics including ionically crosslinked types, and mixtures thereof.

Examples of suitable binder resins include but are not limited to those selected from the group consisting of acrylic and methacrylic polymers and copolymers such as polymethylmethacrylate and styrene acrylates, polyesters, polyurethanes, polycarbonates, polymers and copolymers of vinyl chloride, copolymers of ethylene with acrylics and methacrylics including ionically crosslinked types, and mixtures thereof If the toner is to be made by pulverization methods, then the glass transition temperature ($T_g$) of the toner binder resin is preferably in the range of about 40°–60° C. The melting or softening point of the toner binder resin is preferably such that fusing can be easily accomplished.

Examples of suitable pigments include but are not limited to those selected from the group consisting of titanium dioxide, carbon black, phthalocyanines such as Colour Index Pigment 15 or Colour Index Pigment Green 7, quinacridones such as Colour Index Pigment Violet 19 or Colour Index Pigment Red 122.

For use with colored toners, charge controlling compounds are preferably colorless or nearly colorless. One example of such a charge controlling compound is a quaternary ammonium functional acrylic polymer. The nature of the charge controlling compound can vary depending on whether a positive or negative charging toner is desired.

Preferably the toner particles have average diameters of about 1 to 100 microns, more preferably about 5 to about 50 microns, and most preferably about 5 to about 30 microns.

Additives

A flow additive such as a hydrophobic fumed silica may optionally be added as a separate component to the compositions used according to the present invention from which images are formed. Alternatively, and/or additionally such flow additives may be included in the electrostatically chargeable material attached to the image-enhancing particle. Also, alternatively and/or additionally such flow additives may be included in the toner containing dye(s) and /or pigment(s). It may also be possible to directly attach flow additives to electrostatically printable image-enhancing particles and/or the toner containing dye(s)and/or pigment(s)

Optionally release agents such as low molecular weight waxes may also be incorporated in a similar fashion.

Developer

For the electrophotographic process, the developer used may be either a one-component developer where the toner particle has a magnetic core, or a two-component developer where toner particles adhere to larger magnetic carrier particles by virtue of an electrostatic attraction. A two-component developer approach is generally used for color printing due to the color limitations of toner with a magnetic core. In one particular method the electrostatic attraction results from the toner particles and magnetic carrier particles rubbing together and forming an opposite electrostatic charge in a process referred to as "tribocharging". Tribocharging is a particular method of creating an electrostatic charge. The polarity of this charge depends on the respective materials used for the toner and the magnetic carrier (which may have a polymeric coating) and their position in the triboelectric series. It is therefore possible to have either positive or negative charging toner by suitable selection of the toner material and/or the magnetic carrier material or its optional coating, although toner polarity and magnitude of its tribocharge value has to be matched to the photoconductor and the polarity/magnitude of the charge on the photoconductor. The magnitude of the tribocharge on the toner should be large enough to ensure good and complete attraction between the toner and carrier, but not so large as to keep the toner from being attracted to the charged areas of the photoconductor corresponding to the latent image.

Various embodiments of the present invention are possible, including but not limited to the following:

One embodiment involves electrophotographically printing electrostatically printable image-enhancing particles comprising the steps of: forming an image on a photoconductor via an electrophotographic means, wherein the image is formed from a first composition comprising (I) electrostatically printable image-enhancing particles and (ii) toner particles containing dyes and/or pigments. The image is then provided on the substrate by transferring the image from the photoconductor to the substrate via an electrostatic means. Prior to transfer to the substrate the image is optionally first transferred to an accumulator belt via an electrostatic means. The image is then transferred from the accumulator belt to the substrate via either electrostatic or mechanical means.

A second embodiment involves electrophotographically printing electrostatically printable image-enhancing particles comprising the steps of: Forming a first image on a first photoconductor via an electrophotographic means wherein the first image is formed from the first composition. Next, one or more subsequent image(s) are each formed on separate photoconductors from subsequent compositions via an electrophotographic printing means wherein the subsequent images are each independently formed from a subsequent composition. The images are provided on a substrate by transferring the images in registration from the photoconductor to the substrate via an electrostatic means wherein the images are fused at least after the last image is provided on the substrate and optionally, in addition, after any previous image is provided on the substrate.

A third embodiment involves electrophotographically printing electrostatically printable image-enhancing particles comprising the steps of: forming a first image on a photoconductor via an electrophotographic printing means wherein the first image is formed from a first composition. Next, the image is transferred to an accumulator belt or provided on a substrate via an electrostatic means. Next, one or more subsequent image(s) are each separately formed on the photoconductor via electrophotographic means wherein each subsequent image is each independently formed from a subsequent composition. Each subsequent is image transferred via electrostatic means to an accumulator belt prior to the formation of a subsequent image on the photoconductor via electrophotographic means. The images are provided on a substrate by transferring the images in registration to a substrate via either electrostatic or mechanical means, wherein the images are fused at least after the last image is provided on the substrate and optionally in addition after any previous images are provided on the substrate.

Substrate

The substrate on which the image(s) are deposited to prior to fusing of the image can comprise a variety of materials. The substrate may be transparent, translucent, or opaque. It may or may not be colored. Examples of suitable substrates include, but are not limited to, those selected from the group consisting of coated or uncoated paper, and a variety of polymeric films such as polyvinyl chlorides, polyacrylates, urethanes, and polyesters and blends or copolymers therof. These substrates do not require the presence of any materials necessary for the formation of images electrostatically using liquid toners applied by spray, bar coating, or the like.

EXAMPLES

The invention has been described with reference to various specific and preferred embodiments and will be further described by reference to the following detailed examples. It is understood, however, that there are many extensions, variations, and modifications on the basic theme of the present invention beyond that shown in the examples and detailed description, which are within the spirit and scope of the present invention. All parts, percentages, ratios, etc., in the Examples and elsewhere throughout are by weight unless indicated otherwise.

Specimens 1–3

Specimens 1–3 describe conventional colored toners and two-component developer systems made therefrom.

Specimen 1-Green Toner and Two-Component Developer Made Therefrom

A green toner was prepared by melt mixing 74.0 parts Rohm and Haas Acryloid® B66 (acrylic copolymer), 20.0 parts of a predispersion of 40% Pigment Green 7 (Sun Chemical Sunfast® 264-8142) in acrylic copolymer (B66) and 6.0 parts Dupont Triblox™ PC-100 (positive charge control agent) in a twin-screw extruder at 190°–210° C. The extrudate was allowed to cool and then jet-milled to an average particle size of 3.8 microns as measured with a Microtrac FRA particle analyzer. A two-component developer was prepared by mixing 96 parts polymer coated magnetic carrier (Type 13 from Vertex Image Products, Inc.) with 4 parts toner of the present example and 0.04 parts fumed silica (Degussa AEROSIL® R-504). The resulting tribocharge value was tested to be +20.9 μC/g, using a blow-off technique (Vertex Image Products Model T-100 Tribo Tester).

Specimen 2-Cyan Toner and Two-Part Developer Made Therefrom

A cyan toner was prepared per the method of Specimen 1 by melt mixing 90.0 parts acrylic copolymer (B66), 6.0 parts of a predispersion of 50% Pigment Blue 15:3 (Ciba-Geigy Irgalite® Blue GLG) in acrylic copolymer (B66) and 4.0 parts charge control agent (PC-100). The resulting average particle size was 5.2 microns and the tribocharge value of a two-component developer as prepared per the method of Specimen 1 was +26.9 μC/g.

Specimen 3-Red Toner and Two-Part Developer Made Therefrom

A red toner was prepared per the method of Specimen 1 by melt mixing 83.0 parts acrylic copolymer (B66), 11.0 parts of a predispersion of 50% Pigment Violet 19 (Miles Quindo® Red R-6700) in acrylic copolymer (B66) and 6.0 parts charge control agent (PC-100). The resulting average particle size was 6.6 microns and the tribocharge value of a two-component developer as prepared per the method of Specimen 1 was +19.0 μC/g.

Example 1

An electrostatically printable image-enhancing particle was prepared by melt mixing a mixture of 81 parts Rohm and Haas Acryloid® B-66 (acrylic copolymer), 11.7 parts Silberline DF3622 aluminum flake (36 micron average particle diameter), 3.3 parts Silberline LE1735AR aluminum flake, and 4 parts DuPont Triblox™ PC-100 (positive charge control agent) in a twin -screw extruder at 190°–210° C. The extrudate was allowed to cool and then jet-milled (Nippon IDS-2 jet mill) to an average particle size of 35.4 microns. A two-component developer was prepared by mixing 96 parts Vertex Image Products Type 13 magnetic carrier, 4 parts electrostatically printable image-enhancing particle of the present example and 0.04 part Dugussa AEROSIL(G R-504 fumed silica The resulting tribocharge was determined to be +10.7 μC/g using a blow-off technique (Vertex Image Products Model T-100 Tribo Tester). The two-component developer of the present example was placed in a 3M M-1800 Multifunction Printer (previously available from Minnesota Mining and Manufacturing Company) and a test pattern of 5.1 cm solid squares separated by 0.6 cm borders was printed on paper. The resulting printed images exhibited metallic sparkle with no background dusting.

Example 2

A green metallic image was created by printing the green toner of Specimen 1 in registration over the printed images of Example 1. The resulting printed images exhibited a green metallic sparkle with no background dusting.

Example 3

A blue metallic image was created by printing the cyan toner of Specimen 2 in registration over the magenta toner of Specimen 3 which had been printed in registration over the printed images of Example 1. The resulting printed images exhibited a blue metallic sparkle with no background dusting.

Example 4

An electrostatically chargeable image-enhancing particle was prepared per the method of Example 1 from a mixture of 61 parts acrylic copolymer (B66), 35 parts copper doped zinc sulfide particles (31 micron average particle size) and 4 parts positive charge control agent (PC-100), except that different operating conditions were used during jet-milling resulting in an average particle size of 21.7 microns. A two-component developer prepared as per the method of Example 1 gave a tribocharge value of +8.8 μC/g. The resulting printed images formed according to the method of Example 1 were incorporated into an electroluminescent lamp construction and exhibited image-wise electroluminescence.

Example 5

Dry aluminum flake was prepared by mixing 300 g. Silberline 3122-AR aluminum paste (36 microns average per Silberline literature) with 100 g. mineral spirits to form a slurry. The slurry was then filtered in a Buchner funnel with a Whatman #42 filter paper. The filter cake was washed with 300 grams heptane followed by 100 grams ethyl acetate. The press cake was then broken up and allowed to dry in a 77° C. oven for 2 hours.

A clear metallic toner was prepared by melt mixing 63.0 parts Rohm and Haas Acryloid® B66 (acrylic copolymer), 21.0 parts Union Carbide UCAR® VAGH (vinyl terpolymer), 12.0 parts dry aluminum flake as prepared above and 4.0 parts Hoechst VP2036 (negative charge control agent) in a single-screw extruder (15" Buss-Kneader Type PR46) at 216° C. The extrudate was hammer-milled, and then jet-milled/classified (Donaldson A classifier) to a mean particle size of 29.7 microns as measured with a Microtrac FRA particle analyzer.

A two-component developer was prepared by mixing 95 parts PowderTech Corporation DM070C magnetic carrier (100 micron average size) with 5 parts clear metallic toner as prepared above. The resulting developer was placed in the first print station of a Xeikon DCP-1 color printer. Standard Xeikon cyan, magenta and yellow developers (7.5 micron toner mixed with 70 micron magnetic carrier) were placed in subsequent print stations such that the standard Xeikon cyan, magenta and yellow toners were printed over the clear, metallic toner of the present example. A 0.076 mm biaxially oriented polyethylene terephthalate (PET) film was used as the substrate. The resulting printed images exhibited multi-color metallic sparkle corresponding to areas where cyan, magenta and yellow were used to overprint the clear metallic toner. However, although useful, the cyan, magenta and yellow toners did not print as uniformly over the clear metallic toner as areas where there was no clear metallic toner.

Example 6

The clear metallic developer of the previous example was placed in the last print station of a Xeikon DCP-1 color printer and standard Xeikon yellow, cyan and magenta developers were placed in previous print stations such that the clear metallic toner of the previous example was printed over the standard Xeikon yellow, cyan and magenta toners. A clear overlaminate film was used as the printing substrate which consisted of 8 micron aliphatic urethane heat activated adhesive (Zeneca R9630) coated on 0.025 mm aliphatic urethane (Zeneca R9679) coated on a 0.076 mm PET liner. The resulting printed images were then laminated to 3M Scotchcal® P-3451 white pressure sensitive adhesive coated film at 138° C. (printed surface against Scotchcal( film) followed by stripping off the PET liner of the overlaminate film such that the yellow, cyan and magenta toners were now on top of the clear metallic toner when viewed through the clear overlaminate film. The resulting laminated images exhibited multi-color metallic sparkle corresponding to areas where yellow, cyan and magenta toners were on top of the clear metallic toner. The print quality of the yellow, cyan and magenta toners was unaffected by the overprinting of the clear metallic toner and thus better than that for the previous example.

The foregoing detailed description and Examples have been given for clarity of understanding only. No unnecessary limitations are to be understood therefrom. The invention is not limited to the exact details shown and described, for variations obvious to one skilled in the art will be included within the invention defined by the claims.

It is claimed:

1. A method of electrostatically printing image-enhancing particles comprises the steps of:

(a) providing a first image on a substrate via an electrostatic printing means wherein the first image is formed from a first composition comprising:

(I) optionally, electrostatically printable image-enhancing particles, each electrostatically printable image-enhancing particle comprising:

(A) an image-enhancing particle; and (B) an electrostatically chargeable material attached to at least a portion of an exterior surface(s) of the image-enhancing particle, wherein the electrostatically chargeable material is free of dyes and pigments and wherein the electrostatically chargeable material is selected from the group consisting of transparent materials, translucent materials, opaque materials, and combinations thereof, wherein the electrostatically chargeable material comprises: (i) an electrostatically chargeable polymeric material, and (ii) optionally a charge controlling compound; wherein no more than 80% of the exterior surface of each image-enhancing particle may have an opaque electrostatically chargeable material attached thereto;

(II) optionally toner particles containing a component selected from the group consisting of dyes, pigments, and combinations thereof;

wherein at least one of (a)(I) and (a)(II) is present;

(b) optionally providing one or more subsequent image(s) in registration with said first image wherein said subsequent image(s) are independently formed from a subsequent composition, each subsequent composition independently comprising:

(I) optionally, electrostatically printable image-enhancing particles, each electrostatically printable image-enhancing particle comprising:

(A) an image-enhancing particle; and (B) an electrostatically chargeable material attached to at least a portion of an exterior surface(s) of the image-enhancing particle, wherein the electrostatically chargeable material is free of dyes and pigments and wherein the electrostatically chargeable material is selected from the group consisting of transparent materials, translucent materials, opaque materials, and combinations thereof, wherein the electrostatically chargeable material comprises: (i) an electrostatically chargeable polymeric material, and (ii) optionally, a charge controlling compound; wherein no more than 80% of the exterior surface of each image-enhancing particle may have an opaque electrostatically chargeable material attached thereto;

(II) optionally, toner particles containing a component selected from the group consisting of dyes, pigments, and combinations thereof, wherein at least one of (b)(I) and (b)(II) is present in each subsequent composition, wherein at least one of said first image and/or said subsequent image(s), if present, are formed from a composition comprising electrostatically printable image-enhancing particles; and (c) fusing the deposited image(s) wherein the deposited image(s) are fused at least after the last deposited image is formed, and optionally, in addition, after any previous deposited image(s) are formed.

2. The method of claim 1 wherein the image-enhancing particles are each independently selected from the group consisting of metallic particles, pearlescent particles, phosphor particles, metallic coated glass particles, metallic coated polyester particles, glass particles, and combinations thereof.

3. The method of claim 1 wherein the image-enhancing particles have a shape selected from the group consisting of solid spheres, hollow spheres, and flakes.

4. The method of claim 2 wherein the metallic particles are selected from the group consisting of aluminum, brass, stainless steel, bronze, copper, tin, gold, silver, platinum, and rubidium; and the phosphor particles are selected from the group consisting of metallic doped zinc sulfide.

5. The method of claim 4 wherein the phosphor particles are selected from the group consisting of copper doped zinc sulfide.

6. The method of claim 1 wherein the electrostatically printable image-enhancing particles have average diameters of about 1 to about 200 microns.

7. The method of claim 1 wherein the electrostatically printable image-enhancing particles have average diameters of about 1 to about 100 microns.

8. The method of claim 1 wherein the electrostatically printable image-enhancing particles have average diameters of about 5 to about 50 microns.

9. The method of claim 1 wherein the toner particles have average diameters of about 1 to 100 microns.

10. The method of claim 1 wherein the toner particles have average diameters of about 5 to 50 microns.

11. The method of claim 1 wherein the toner particles have average diameters of about 5 to 30 microns.

12. The method of claim 1 wherein the image-enhancing particles have diameters of about 1 to 200 microns.

13. The method of claim 1 wherein the electrostatically chargeable material is selected from the group consisting of transparent and translucent materials.

14. The method of claim 1 wherein the electrostatically chargeable material is selected from the group consisting of transparent materials.

15. The method of claim 1 wherein the electrostatically chargeable polymeric material is selected from the group consisting of acrylic polymers, methacrylic polymers, acrylic copolymers, methacrylic copolymers, polyesters, polyurethanes, polycarbonates, vinyl chloride polymers, vinyl chloride copolymers, ethylene and acrylic copolymers, ethylene and methacrylic copolymers, ionically crosslinked ethylene and acrylic copolymers, ionically crosslinked ethylene and methacrylic copolymers, and mixtures thereof.

16. A printed substrate prepared according to the method of claim 1.

17. The method of claim 1 wherein the first composition is free of element (a)(II) and wherein subsequent compositions are each free of element (b)(I).

18. The method of claim 1 wherein the first composition is free of element (a)(I) and wherein all subsequent compositions except for the last subsequent composition are each free of element (b)(I) and wherein the last subsequent composition comprises (b)(I) but is free of (b)(II).

19. The method of claim 17 which further comprises a step (c) of bonding a clear overlaminate to the fused image (s) after step (b).

20. The method of claim 18 wherein the substrate is a clear film and wherein the method further comprises a step (c) of bonding to the fused image(s) an element selected from the group consisting of a second substrate and an adhesive layer after step (b).

21. A printed substrate prepared according to the method of claim 19.

22. A printed substrate prepared according to the method of claim 20.

23. The method of claim 1 wherein in providing the first image on the substrate the first image is first formed on a photoconductor via an electrophotographic means, after which the first image is transferred from the photoconductor to the substrate via an electrostatic means, wherein prior to transfer of the first image to the substrate the first image is optionally first transferred to an accumulator belt from the photoconductor via an electrostatic means and then transferred from the accumulator belt to the substrate via a means selected from the group consisting of electrostatic and mechanical means.

24. The method of claim 1 wherein in providing the first image on the substrate the first image is first formed on a first photoconductor via an electrophotographic means and wherein in providing the one or more subsequent image(s) on the substrate one or more subsequent image(s) are each formed on separate photoconductors from subsequent composition(s) via an electrophotographic means, wherein the first and subsequent image(s) are provided on substrate by transferring the images in registration from the photoconductors to the substrate via an electrostatic means wherein the images are fused at least after the last image is provided on the substrate and optionally, in addition, after any previous image is provided on the substrate.

25. The method of claim 1 wherein in providing the first image on the substrate the first image is first formed on a photoconductor via an electrophotographic means, followed by transferring the first image to an accumulator belt or on the substrate via an electrostatic means, and wherein the one or more subsequent image(s) are each provided on the substrate by first separately forming on the photoconductor via electrophotographic means each subsequent image, wherein each subsequent image is transferred via electrostatic means to an accumulator belt prior to the formation of a later subsequent image on the photoconductor via electrophotographic means, wherein the first and subsequent image (s) are provided on the substrate by transferring the first and subsequent image(s) in registration to a substrate via a means selected from the group consisting of electrostatic and mechanical means, wherein the images are fused at least after the last image is provided on the substrate and optionally in addition after any previous images are provided on the substrate.

26. The method of claim 1 wherein the electrostatically chargeable image-enhancing particles are in at least one composition(s) free of the toner particles, and wherein the electrostatically chargeable image-enhancing particles in the compositions free of the toner particles are: (1) of a larger dimension than the dimensions of the toner particles which are in any of the compositions which are free of electrostatically chargeable image-enhancing particles; and (2) of a larger dimension than the dimensions of any toner particles which are combined in any of the compositions with electrostatically printable image-enhancing particles; and (3) of a larger dimension than the dimensions of any electrostatically printable image-enhancing particles combined in any of the compositions with the toner particles.

* * * * *